US007469560B1

(12) United States Patent
Pai

(10) Patent No.: US 7,469,560 B1
(45) Date of Patent: Dec. 30, 2008

(54) YARN LOOP DENSITY ADJUSTMENT APPARATUS FOR CIRCULAR KNITTING MACHINES

(75) Inventor: Tieh-Hsiung Pai, Taipei Hsien (TW)

(73) Assignee: Pai Lung Machinery Mill Co. Ltd., Taipei Hsien (JP)

( * ) Notice: Subject to any disclaimer, the term of this patent is extended or adjusted under 35 U.S.C. 154(b) by 0 days.

(21) Appl. No.: 11/898,329

(22) Filed: Sep. 11, 2007

(51) Int. Cl.
*D04B 15/36* (2006.01)

(52) U.S. Cl. ..... 66/78

(58) Field of Classification Search ..... 66/8, 66/54, 55, 57, 77, 78
See application file for complete search history.

(56) References Cited

U.S. PATENT DOCUMENTS 4,331,007 A * 5/1982 Marchisio ..... 66/55
4,712,390 A * 12/1987 Lonati ..... 66/54
4,934,161 A * 6/1990 Dalmau Guell ..... 66/54
5,018,370 A * 5/1991 Tsuchiya ..... 66/55
5,212,967 A * 5/1993 Shibata et al. ..... 66/55
5,511,392 A 4/1996 Sawazaki et al.
7,065,988 B2 6/2006 Lonati et al.

FOREIGN PATENT DOCUMENTS

TW 247597 10/2004
TW 251848 12/2004

* cited by examiner

*Primary Examiner*—Danny Worrell
(74) *Attorney, Agent, or Firm*—Muncy, Geissler, Olds & Lowe, PLLC

(57) ABSTRACT

A yarn loop density adjustment apparatus for circular knitting machines is installed on a circular knitting machine which has at least one needle to draw a knitting yarn. The yarn loop density adjustment apparatus includes a saddle seat coupled on the circular knitting machine and a driving means installed on the saddle seat. The saddle seat has a transmission mechanism driven by the driving means, a slider driven by the transmission mechanism and a cam fastened to the slider to guide movements of the needle. The transmission mechanism has first teeth. The slider has second teeth corresponding to and engageable with the first teeth. When the transmission mechanism is driven by the driving means, the slider is driven to generate a moving displacement through the engaged first teeth and the second teeth.

13 Claims, 7 Drawing Sheets

YARN LOOP DENSITY ADJUSTMENT APPARATUS FOR CIRCULAR KNITTING MACHINES

FIELD OF THE INVENTION

The present invention relates to a yarn loop density adjustment apparatus for circular knitting machines and particularly to a yarn loop density adjustment apparatus capable of adjusting individual cam on a saddle seat.

BACKGROUND OF THE INVENTION

A circular knitting machine can control the yarn loop density of fabrics by adjusting the position of cams. The circular knitting machine has a plurality of cams to adjust the yarn loop density at different locations of a fabric.

Conventional techniques mostly aim to adjust the position of a single cam. For instance, R.O.C utility patent Nos. M251848 and M247597 granted to the Applicant disclose an adjustment method that has a regulation wheel turnable to drive a slider to adjust the position of a cam. The adjustment task is done manually. When the number of cams to be adjusted is great, to do adjustment takes a great deal of manpower and time. Human errors also are prone to occur. To remedy this problem, U.S. Pat. No. 5,511,392 discloses a method which has an elevating means to adjust the vertical position of a mounting plate, thereby saddle seats which hold cams and are located on the mounting plate can be moved up or down. While it can adjust the vertical positions of multiple cams, it cannot fine tune the yarn loop density of individual fabric zones.

U.S. Pat. No. 7,065,988 discloses a device aiming to alter stitch tightness of circular knitting machines. It is coupled with a movement adjuster connecting to a slider which is slidable on a cam box of a knitting machine and supports a knockover cam. The movement adjuster includes an actuator connecting to an adjustment cam, and may be driven to rotate the adjustment cam about its axis to a selected angle. The adjustment cam has an external active profile and two cam followers that are located on the slider. When the adjustment cam is driven by the actuator, the two cam followers adjust the cam position on the slider. It aims to adjust the position of a single cam without relying on moving up or down of the mounting plate. The actuator also provides driving to eliminate the uncertainty of human control and tedious operation. The adjustment cam is an eccentric cam in contact with the two cam followers. The contact positions require precise calculation and fabrication to ensure that the cam can provide accurate movement. Moreover, the adjustment cam is embedded deeply in the saddle seat. Its size and moving track range are restricted. Thus fabrication is difficult.

SUMMARY OF THE INVENTION

The primary object of the present invention is to provide positional adjustment for a single cam. It is structured simpler, and easier to fabricate or install in practice. To achieve the foregoing object the present invention provides a yarn loop density adjustment apparatus for circular knitting machines. It is installed on a circular knitting machine which has at least one needle to draw a knitting yarn. The yarn loop density apparatus includes a saddle seat coupled on the circular knitting machine and a driving means installed on the saddle seat. The saddle seat has a transmission mechanism driven by the driving means, a slider driven by the transmission mechanism and a cam fastened to the slider to guide movements of the needle. The slider and the saddle seat are interposed by an elastic element to keep the slider in contact with the transmission mechanism. The transmission mechanism has first teeth. The slider has second teeth corresponding to the first teeth. When the transmission mechanism is driven by the driving means, through mutual engagement of the first teeth and the second teeth, the slider can be driven to generate a moving displacement. By means of the mating teeth formed on the transmission mechanism and the slider the position of the cam can be precisely adjusted.

Another object of the invention is to prevent errors resulting from manual adjustment of the cam position, and maintain or adjust any time the cam position during operation of the circular knitting machine. To achieve this object the invention further includes a detection means to detect a driving condition of the driving means. The detection means generates a detection signal according to the driving condition of the driving means and inputs to a processing unit. The processing unit feedbacks an adjustment signal based on the detection signal to the driving means to adjust the driving condition thereof. The driving condition is the rotational speed of the driving means. The processing unit can preset a standard signal to determine the cam position and compare with the detection signal to output of the adjustment signal. Thus the cam can be moved to a preset position through the standard signal during operation of the circular knitting machine. Or the cam position may be changed during operation of the circular knitting machine to alter the yarn loop density to fabricate more versatile patterned fabrics.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
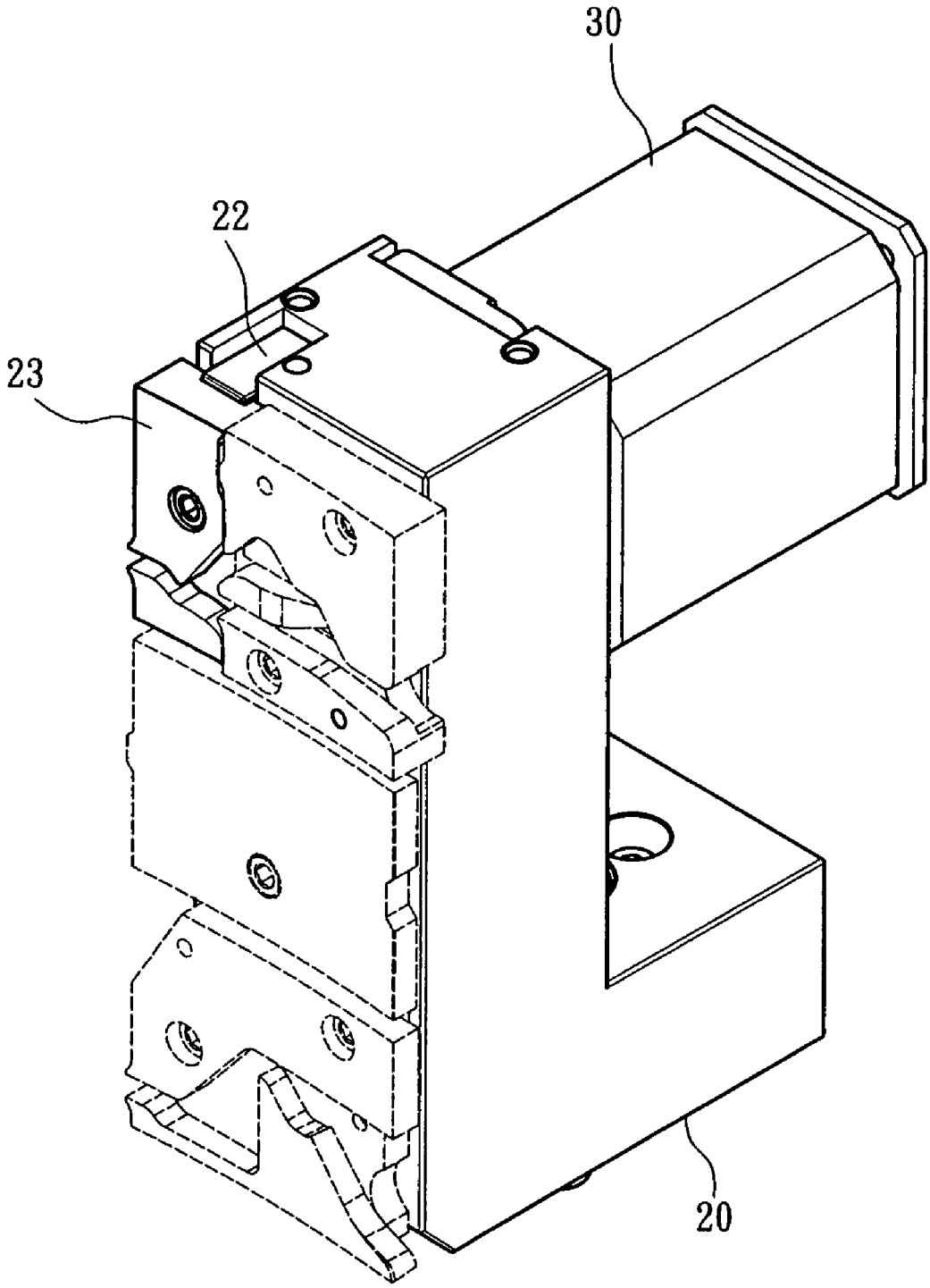
FIG. 1 is a perspective view of an embodiment of the yarn loop density adjustment apparatus for circular knitting machines of the invention.
Figure 2:
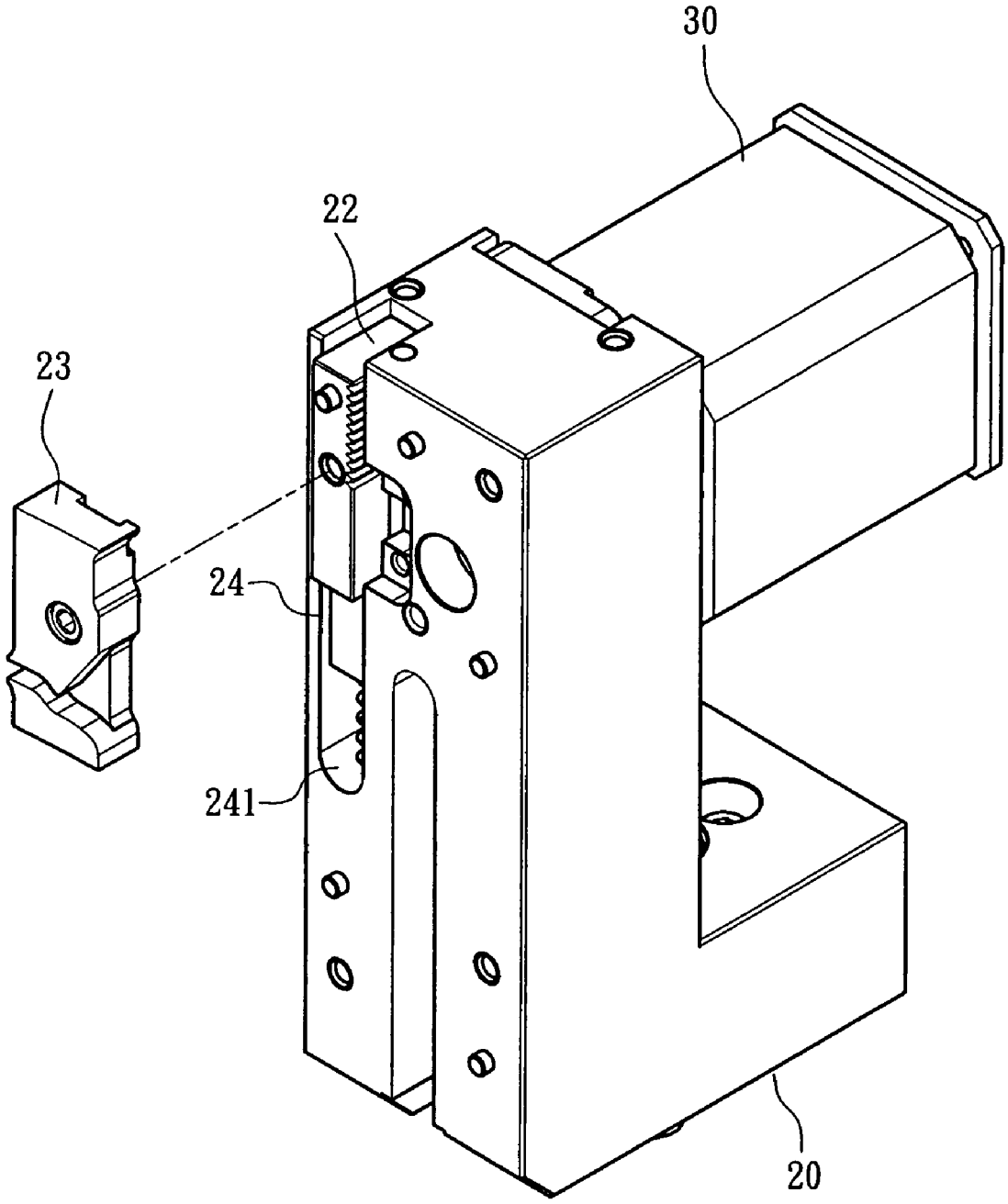
FIG. 2 is an exploded view of an embodiment of the yarn loop density adjustment apparatus for circular knitting machines of the invention.
Figure 3:
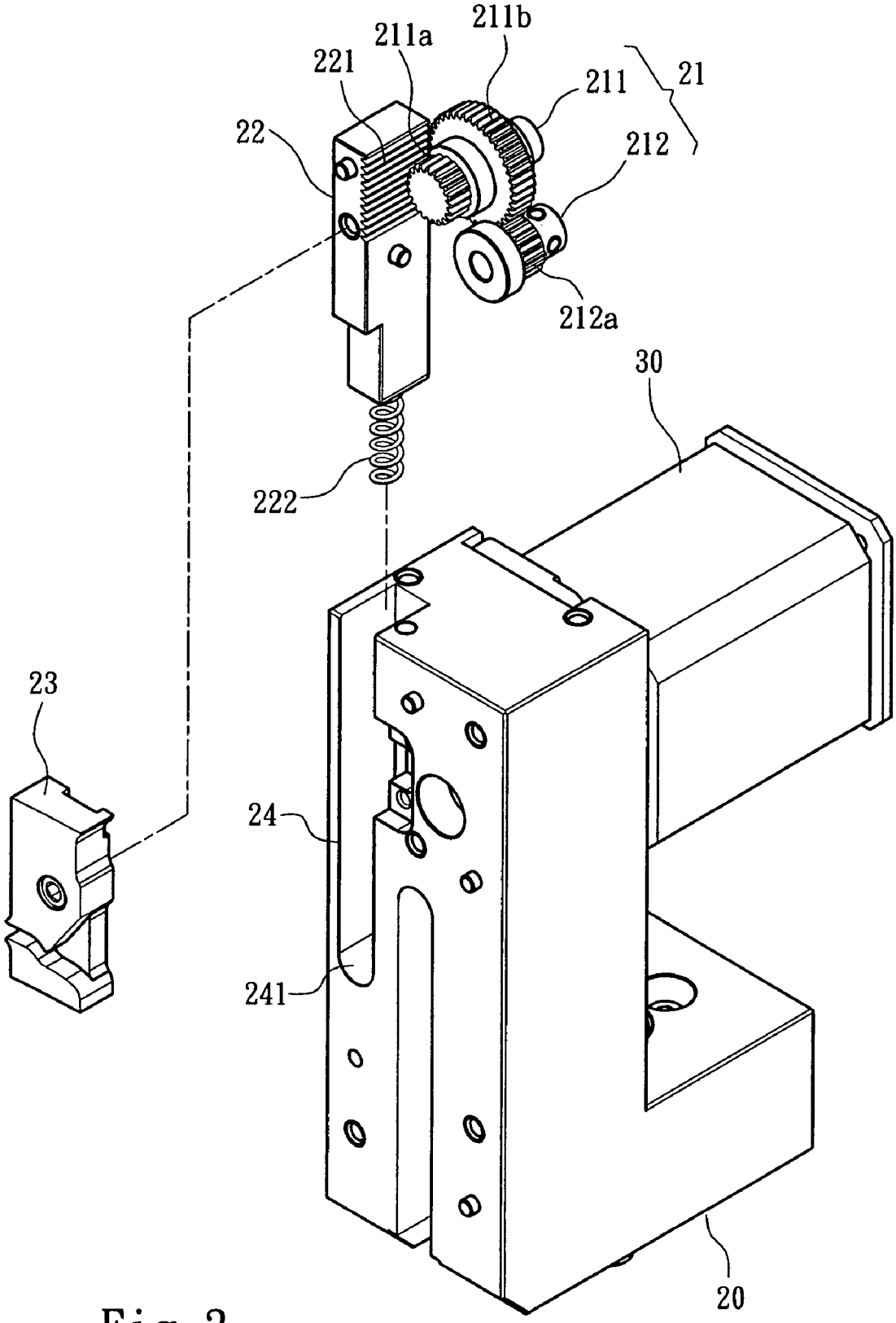
FIG. 3 is another exploded view of an embodiment of the yarn loop density adjustment apparatus for circular knitting machines of the invention.

Please refer to FIGS. 1, 2 and 3 for an embodiment of the invention. The yarn loop density adjustment apparatus for circular knitting machines of the invention is installed on a circular knitting machine which has at least one needle (not shown in the drawings) to draw a knitting yarn. The yarn loop density adjustment apparatus includes a saddle seat 20 coupled on the circular knitting machine and a driving means 30 installed on the saddle seat 20. The saddle seat 20 has a transmission mechanism 21 driven by the driving means 30, a slider 22 driven by the transmission mechanism 21 and a cam 23 fastened to the slider 22 to guide movements of the needle.

In this embodiment the driving means 30 is a serve motor to provide the driving source of the transmission mechanism 21. The transmission mechanism 21 is a gear set including a first gear 211 driven by the slider 22, a second gear 212 coupled with the driving means 30 and be driven thereof to drive the first gear 211. The first gear 211 has first teeth 211*a* formed thereon. The slider 22 has second teeth 221 mating the first teeth 211*a*. Moreover, the first gear 211 further has third teeth 211*b*. The second gear 212 has fourth teeth 212*a* mating the third teeth 211*b*. When the driving means 30 drives the second gear 212, through engagement of the fourth teeth 212*a* and the third teeth 211*b*, the first gear 211 is driven and rotates. Through engagement of the first teeth 211*a* of the first gear 211 and the second teeth 221 of the slider 22, the slider 22 is driven to generate a moving displacement.

To avoid not fully engagement resulting from tolerances of the second teeth 221 and the first teeth 211*a* that might cause a displacement error of the slider 22 driven by the driving means 30 through the transmission mechanism 21, an elastic element 222 may be interposed between the slider 22 and the saddle seat 20 to push the slider 22 in contact with the transmission mechanism 21. In this embodiment the saddle seat 20 has a track 24 to hold the moving displacement of the slider 22. The elastic element 222 has one end coupling with the slider 22 and other end coupling with the bottom 241 of the track 24. The elastic element 222 provides a force to push the slider 22 in contact forcefully with the first gear 211 so that the engagement of the second teeth 221 of the slider 22 and the first teeth 211*a* of the first gear 211 is closer and tighter. Thus when the transmission mechanism 21 rotates it can precisely drive the slider 22 to generate the moving displacement as desired.

Figure 4:
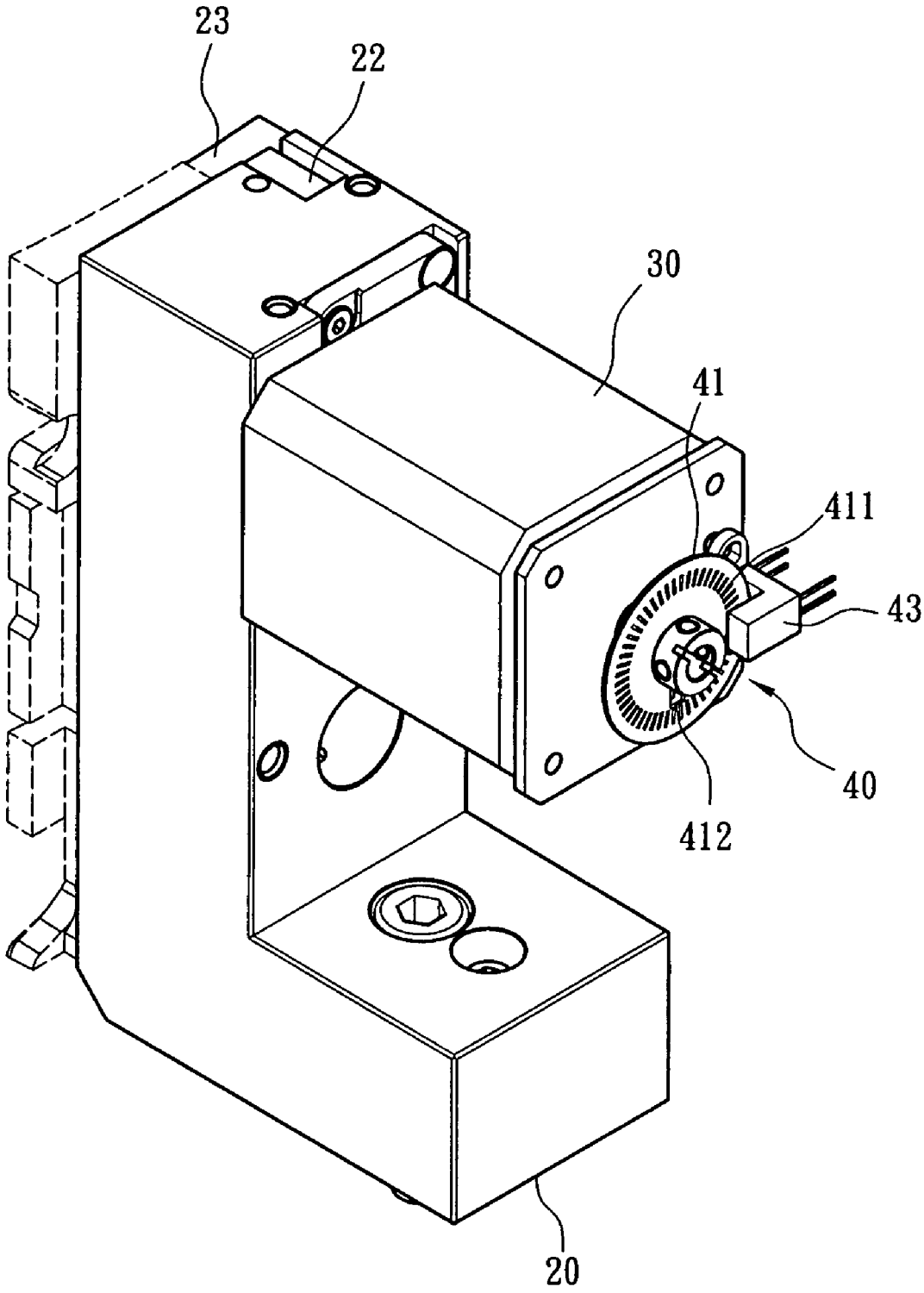
FIG. 4 is a perspective view of another embodiment of the yarn loop density adjustment apparatus for circular knitting machines of the invention.
Figure 5:
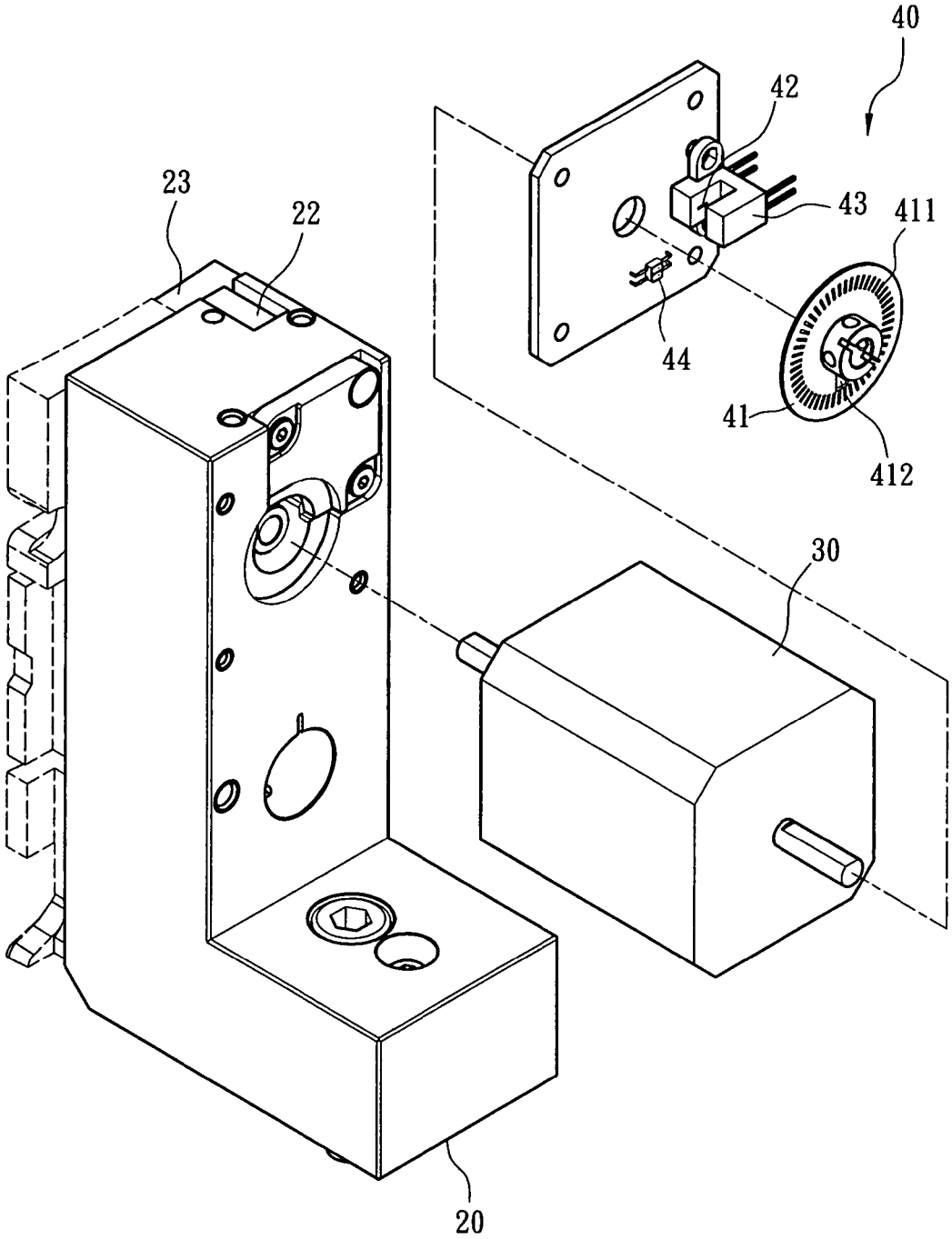
FIG. 5 is an exploded view of another embodiment of the yarn loop density adjustment apparatus for circular knitting machines of the invention.

Refer to FIGS. 4 and 5 for another embodiment of the invention. The yarn loop density adjustment apparatus for circular knitting machines further has a detection means 40 located on the driving means 30 to detect the driving condition thereof. The detection means 40 is used on the driving means 30 which includes a stepping motor or server motor. The detection means 40 includes an optical grid disk 41 driven by the driving means 30 to be rotated therewith, a light emitter 42 and a light receiver 43 located on a light emission path. The optical grid disk 41 has a plurality of scale holes 411 that are equally spaced from one another to allow the light emitted from the light emitter 42 to pass through and reach the light receiver 43. When the optical grid disk 41 is driven and rotated by the driving means 30, the light emitted from the light emitter 42 passes through or is blocked due to the spaced scale holes 411. Thus based on the number and frequency of the light being spaced the rotation angle and speed can be calculated.

To facilitate interpretation and determination of the rotational position of the optical grid disk 41, the optical grid disk 41 further has an initial hole 412. And the detection means 40 has an initial spot sensor 44 corresponding to the initial hole 412. External light can trigger the initial spot sensor 44 through the initial hole 412 to allow detection to be performed to indicate that the optical grid disk 41 has finished one cycle of rotation or being located at the initial spot position.

Figure 6:
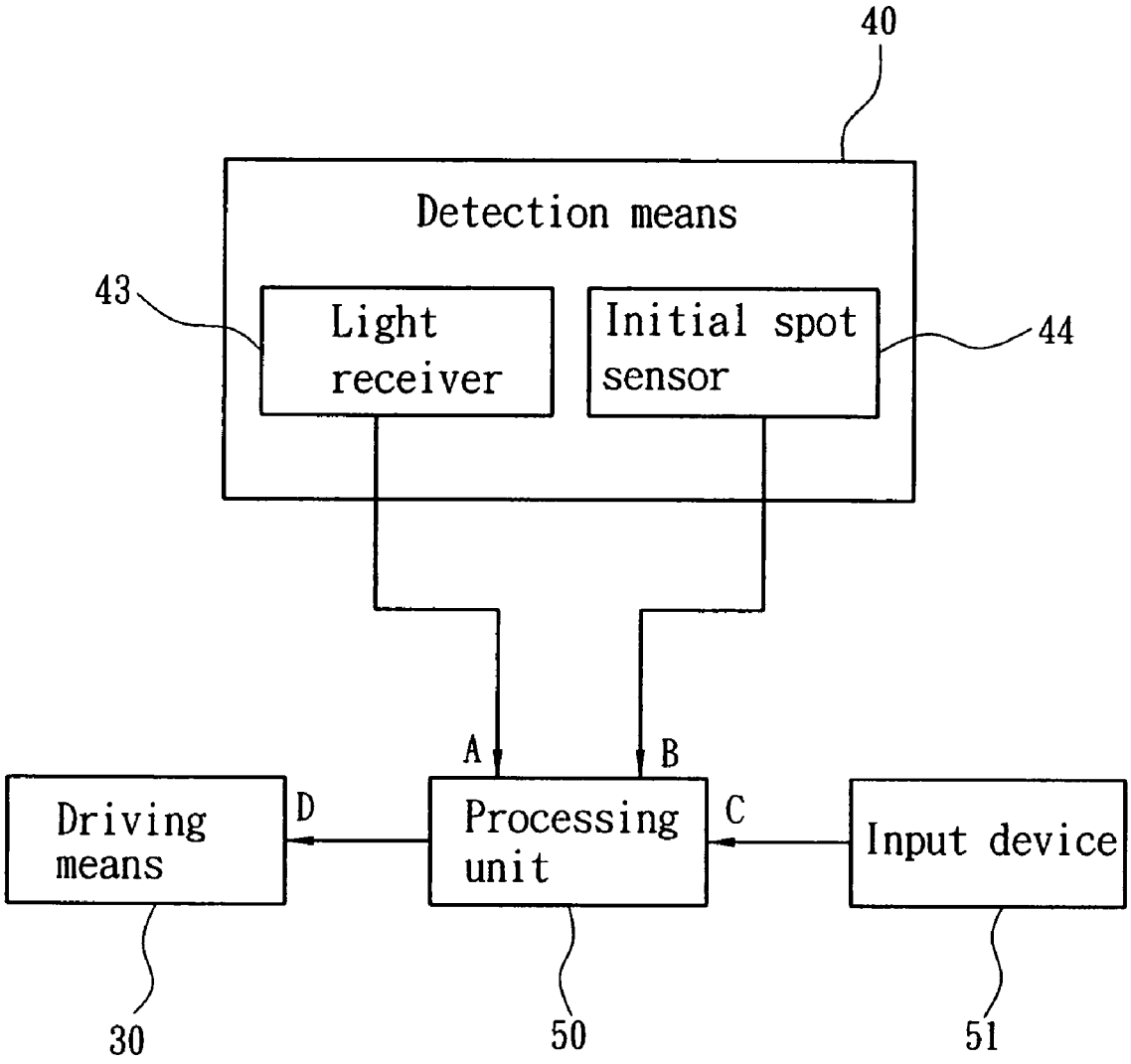
FIG. 6 is a signal block diagram of another embodiment of the yarn loop density adjustment apparatus for circular knitting machines of the invention.

Refer to FIG. 6 for the signal block diagram of another embodiment of the invention showing. The detection means 40 is electrically connected to a processing unit 50. As previously discussed, the detection means 40 includes the light receiver 43 and the initial spot sensor 44. The light receiver 43 detects the driving condition of the driving means 30 and generates a first detected signal A. The driving condition may be rotational speed or direction. The initial spot sensor 44 detects the initial hole 412 of the optical grid disk 41 and generates a second detected signal B. Both the first and second detected signals A and B are input into the processing unit 50 which, through an input device 51, can preset a standard signal C to determine the position of the cam 23. The input device 51 may be a keyboard, mouse, or touch panel. The references of input device 51 r mentioned above serve only for illustrative purpose, and are not the limitation of the invention. The detected signal A or B input to the processing unit 50 is compared with the standard signal C, and an adjustment signal D is sent back to the driving means 30 to adjust the driving condition thereof.

Figure 7B:
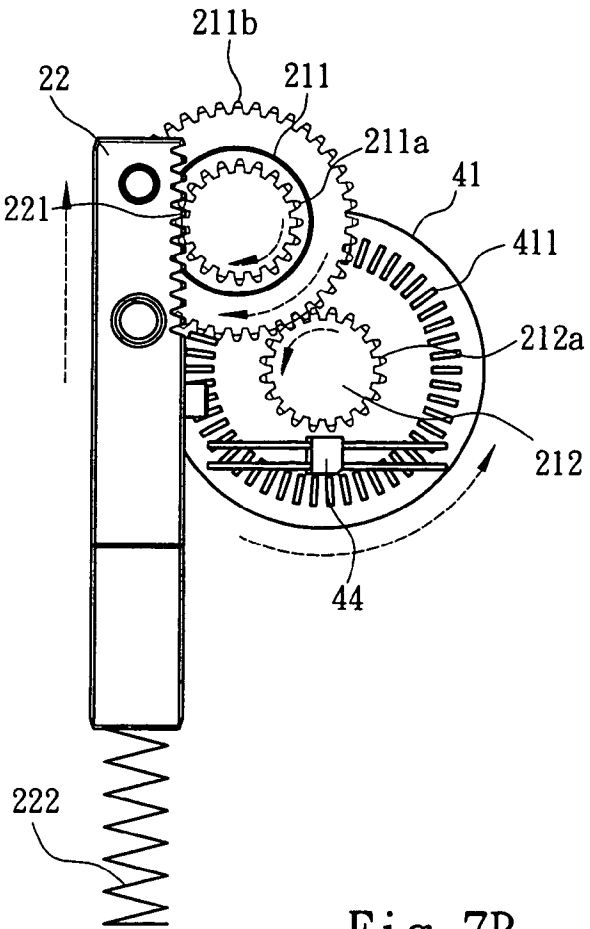
FIG. 7B is a schematic view of another embodiment of the yarn loop density adjustment apparatus for circular knitting machines of the invention in another operating condition.
Figure 7A:
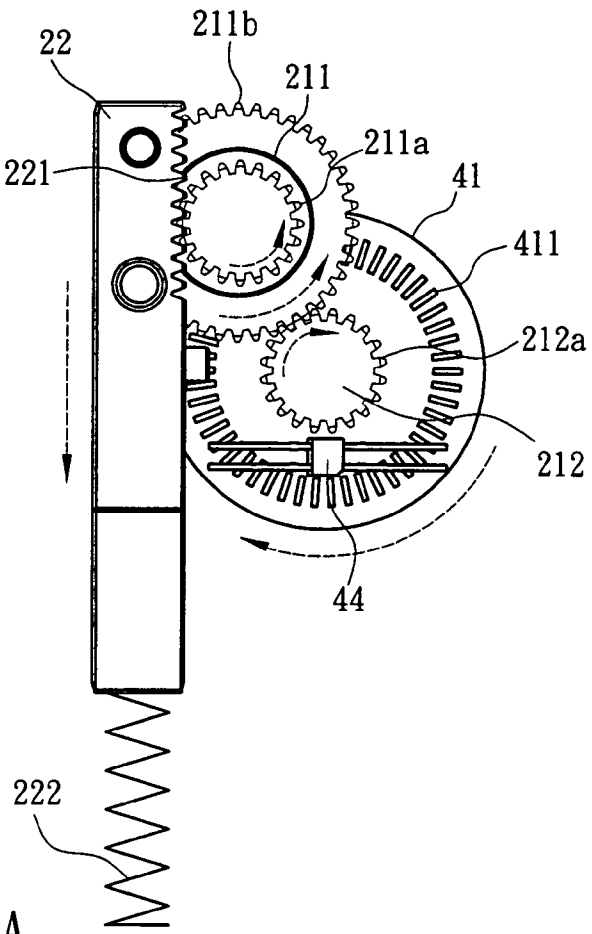
FIG. 7A is a schematic view of another embodiment of the yarn loop density adjustment apparatus for circular knitting machines of the invention in an operating condition.

Before or during operation of the circular knitting machine equipped with the invention, enter the standard signal C that determines the position of the cam 23 through the input device 51 to the processing unit 50, and output the adjustment signal D to the driving means 30 to activate or adjust the driving condition of the driving means 30. The driving means 30 is a server motor. Based on the adjustment signal D the rotational speed or direction may be changed. The server motor drives the second gear 212 to rotate, and through the fourth teeth 212*a* and the third teeth 211*b* that are engaged, the rotation is transmitted to the first gear 211. Then through the engagement of the first teeth 211*a* and the second teeth 221, the slider 22 can be moved to the displacement desired. Referring to FIG. 7A, when the server motor rotates in the clockwise direction, the slider 22 is moved downwards along the track 24 of the saddle seat 20. On the other hand, when the server motor rotates in the counterclockwise direction, the slider 22 is moved upwards along the track 24 of the saddle seat 20 as shown in FIG. 7B. As the cam 23 is fastened to the slider 22, when the slider 22 is moved along the track 24 of the saddle seat 20, the cam 23 also is moved upwards or downwards. During operation of the circular knitting machine, the detection means 40 continuously detects the driving condition of the driving means 30, including the rotational speed or direction. As the optical grid disk 41 is coupled with the driving means 30 (referring to FIGS. 7A and 7B), the detected signals A and B can be input to the processing unit 50 through the light receiver 43 and initial spot sensor 44 to indicate the driving condition of the driving means 30, or the actual position of the cam 23. As the driving condition of the driving means 30 can be detected through the light receiver 43 and initial spot sensor 44, and through the input device 51*a* preset driving condition may be set, by comparing the detected signals A and B with the standard signal C, the adjustment signal D can be sent back to the driving means 30 to adjust the driving condition of the driving means 30 at a preset condition, and also move the cam 23 to the preset position.

As a conclusion, the yarn loop density adjustment apparatus for circular knitting machines of the invention can adjust the position of a single cam 23 to control the yarn loop density to fabricate fabrics with more versatile patterns. Through a simple gear set to drive the movement of the slider 22 the position of the cam 23 can be adjusted. It greatly reduces fabrication difficulty. In cooperating with the detection means 40 to detect the driving condition, the displacement of the cam 23 can be adjusted precisely. Thus the present invention provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A yarn loop density adjustment apparatus for circular knitting machines installed on a circular knitting machine which has at least one needle to draw a yarn, comprising:

a saddle seat which is coupled on the circular knitting machine and has a transmission mechanism, a slider driven by the transmission mechanism and a cam fastened to the slider to guide movements of the needle; and a driving means installed on the saddle seat to drive the transmission mechanism;

wherein the transmission mechanism has first teeth, the slider having second teeth corresponding to and engageable with the first teeth, the transmission mechanism driven by the driving means moving the slider to generate a moving displacement through the engaged first teeth and the second teeth.

2. The yarn loop density adjustment apparatus of claim 1, wherein the transmission mechanism is a gear set.

3. The yarn loop density adjustment apparatus of claim 1, wherein the slider and the saddle seat are interposed by an elastic element to push the slider in contact with the transmission mechanism.

4. The yarn loop density adjustment apparatus of claim 1, wherein the driving means is a server motor.

5. A yarn loop density adjustment apparatus for circular knitting machines installed on a circular knitting machine, comprising:

a saddle seat which is coupled on the circular knitting machine and has a transmission mechanism, a slider driven by the transmission mechanism and a cam fastened to the slider, the transmission mechanism having first teeth, the slider having second teeth corresponding to the first teeth;

a driving means installed on the saddle seat to drive the transmission mechanism; and a detection means located on the driving means to detect a driving condition of the driving means;

wherein the detection means generates a detected signal according to the driving condition of the driving means and inputs to a processing unit which feeds back an adjustment signal based on the detection signal to the driving means to adjust the driving condition thereof.

6. The yarn loop density adjustment apparatus of claim 5, wherein the transmission mechanism is a gear set.

7. The yarn loop density adjustment apparatus of claim 5, wherein the slider and the saddle seat are interposed by an elastic element to push the slider in contact with the transmission mechanism.

8. The yarn loop density adjustment apparatus of claim 5, wherein the driving means is a server motor.

9. The yarn loop density adjustment apparatus of claim 5, wherein the driving means is a stepping motor.

10. The yarn loop density adjustment apparatus of claim 5, wherein the driving condition of the driving means is the rotational speed or rotational direction thereof.

11. The yarn loop density adjustment apparatus of claim 5, wherein the processing unit presets a standard signal to determine the position of the cam and outputs the adjustment signal after having compared with the detected signal.

12. The yarn loop density adjustment apparatus of claim 5, wherein the detection means includes an optical grid disk driven by the driving means, a light emitter and a light receiver located on a light emission path, the optical grid disk having a plurality of scale holes that are equally spaced and allow light emitted from the light emitter to pass through and reach the light receiver.

13. The yarn loop density adjustment apparatus of claim 12, wherein the detection means further has an initial spot sensor, the optical grid disk having an initial hole corresponding to the initial spot sensor to allow the light to reach the initial spot sensor.

* * * * *